US006318500B1

(12) United States Patent
Mizani

(10) Patent No.: US 6,318,500 B1
(45) Date of Patent: Nov. 20, 2001

(54) OIL DRAIN PLUG APPARATUS AND METHOD

(76) Inventor: Bijan Mizani, 370 N. Civic Dr. #206, Walnut Creek, CA (US) 94596

( * ) Notice: Subject to any disclaimer, the term of this patent is extended or adjusted under 35 U.S.C. 154(b) by 0 days.

(21) Appl. No.: 09/441,634

(22) Filed: Nov. 16, 1999

Related U.S. Application Data

(60) Provisional application No. 60/109,086, filed on Nov. 19, 1998.

(51) Int. Cl.[7] ..... F01M 11/04

(52) U.S. Cl. ..... 184/1.5; 184/105.3

(58) Field of Search ..... 184/1.5, 105.3; 251/321, 324, 144; 141/98, 383; 123/196 S, 196 A

(56) References Cited

U.S. PATENT DOCUMENTS

| | | | | |
|---|---|---|---|---|
| 1,596,049 | * | 8/1926 | Kienast | 251/324 |
| 1,992,371 | * | 2/1935 | Hammond et al. | 184/1.5 |
| 1,995,174 | * | 3/1935 | Gerrard et al. | 184/1.5 |
| 3,310,133 | * | 3/1967 | Eaker | 184/1.5 |
| 3,477,459 | * | 11/1969 | Schossow | 184/1.5 |
| 3,871,483 | * | 3/1975 | Espinosa et al. | 184/1.5 |
| 3,954,250 | * | 5/1976 | Grace | 184/1.5 |
| 4,086,981 | * | 5/1978 | Mitsui | 184/1.5 |
| 4,319,664 | * | 3/1982 | Price et al. | 184/1.5 |
| 4,393,893 | * | 7/1983 | Alexander | 184/105.3 |
| 4,676,206 | * | 6/1987 | DeGrazia, Jr. | 184/1.5 |
| 4,745,989 | * | 5/1988 | DiMatteo | 184/1.5 |
| 4,901,693 | * | 2/1990 | DeGrazia, Jr. | 184/1.5 |
| 4,905,643 | * | 3/1990 | DeGrazia, Jr. | 184/1.5 |
| 4,907,676 | * | 3/1990 | Shirdavani | 184/1.5 |
| 4,917,356 | * | 4/1990 | Shirdavani | 184/1.5 |
| 5,259,588 | * | 11/1993 | Crosby, Jr. et al. | 184/1.5 |
| 5,411,115 | | 5/1995 | Shropshire | 184/1.5 |
| 5,522,475 | * | 6/1996 | Thompson | 184/1.5 |
| 5,630,451 | * | 5/1997 | Bernard | 184/1.5 |
| 5,667,195 | * | 9/1997 | McCormick | 184/1.5 |
| 5,727,652 | * | 3/1998 | Ho | 184/1.5 |
| 5,975,175 | * | 11/1999 | Ashford | 184/1.5 |

* cited by examiner

*Primary Examiner*—Thomas R. Hannon
*Assistant Examiner*—Chong H. Kim
(74) *Attorney, Agent, or Firm*—Irell & Manella LLP

(57) ABSTRACT

The present invention comprises an oil drain plug apparatus. In one embodiment, the oil drain plug apparatus includes a housing having an opening for receiving a member that moves within the opening between first and second positions. The housing includes a top opening that screwably receives an inlet port of an oil drain plug. The oil drain plug includes an outlet port for mounting to an oil pan of an engine. The housing includes a bottom opening that is substantially aligned with the top opening. The member includes a center opening that is substantially parallel to the top and bottom openings of the housing. When the member is in a first position, the center opening is not aligned with the top and bottom opening, preventing oil from draining from the oil pan. When the member is moved to the second position, the center opening is substantially aligned with the top and bottom openings of the housing, allowing oil to be drained from the oil pan. The member is coupled to a plate. At least one spring element is placed between the plate and the housing. When the member is in the first position, the spring element provides resistance against the plate, preventing the member from moving due to vibrations. When a force causes the member to move to the second position, the spring element provides greater resistance against the plate, forcing the member back to the first position when the force is removed.

10 Claims, 5 Drawing Sheets

OIL DRAIN PLUG APPARATUS AND METHOD

CROSS-REFERENCE OF RELATED CASE

This is a non-provisional application of a provisional Application Serial No. 60/109,086, entitled "OIL DRAIN PLUG APPARATUS AND METHOD", filed Nov. 19, 1998.

BACKGROUND OF THE INVENTION

1. Field of the Invention

The present invention relates generally to the field of oil drain plug apparatuses, and specifically, to an oil drain plug apparatus and corresponding method for facilitating the changing of engine oil of a vehicle.

2. Background Information

It is generally recommended that the engine oil of an automobile be changed every three thousand or so miles. Over a 100,000 mile span, this amounts to a maximum of about 33 oil changes. Changing engine oil of a vehicle is an unpleasant and, often, dirty experience. Typically, this requires one to raise the automobile on a jack, unscrew the oil drain plug, allow oil to be drained, and then screw the oil drain plug back securely. It is critical that the oil drain plug is screwed in the oil pan just right, i.e., not too tight and not too loose. If the oil drain plug is tightened too much, it may break. Also, if the oil drain plug is not screwed into the oil pan correctly, the oil pan thread may be damaged and cause oil to leak, potentially costing the automobile owner a lot of money for repairs. For the majority of the people who do not have means to raise an automobile in order to gain access to the oil drain plug and change the engine oil, they are generally left with the option of paying a mechanic to perform such a job.

Accordingly, there is a need in the technology for a method and apparatus for overcoming the aforementioned drawbacks, while facilitating the changing of engine oil of a vehicle.

SUMMARY OF THE INVENTION

The present invention comprises an oil drain plug apparatus. In one embodiment, the oil drain plug apparatus includes a housing having an opening for receiving a member that moves within the opening between first and second positions. The housing includes a top opening that screwably receives an inlet port of an oil drain plug. The oil drain plug includes an outlet port for mounting to an oil pan of an engine. The housing includes a bottom opening that is substantially aligned with the top opening. The member includes a center opening that is substantially parallel to the top and bottom openings of the housing. When the member is in a first position, the center opening is not aligned with the top and bottom opening, preventing oil from draining from the oil pan. When the member is slidably moved to the second position, the center opening is substantially aligned with the top and bottom openings of the housing, allowing oil to be drained from the oil pan.

DETAILED DESCRIPTION

Figure 1:
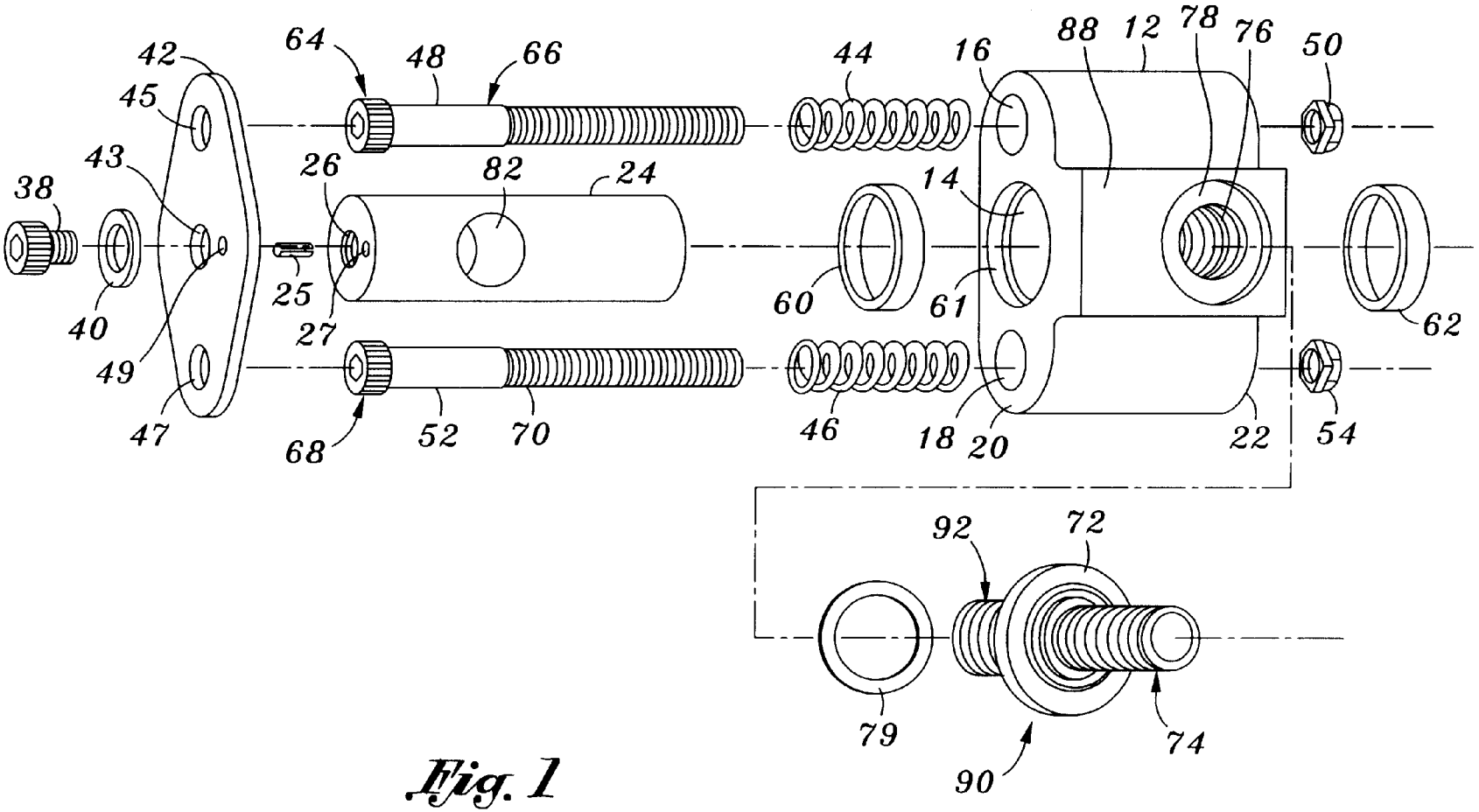
FIG. 1 illustrates an isometric view of an oil drain plug apparatus according to one embodiment of the present invention.
Figure 2:
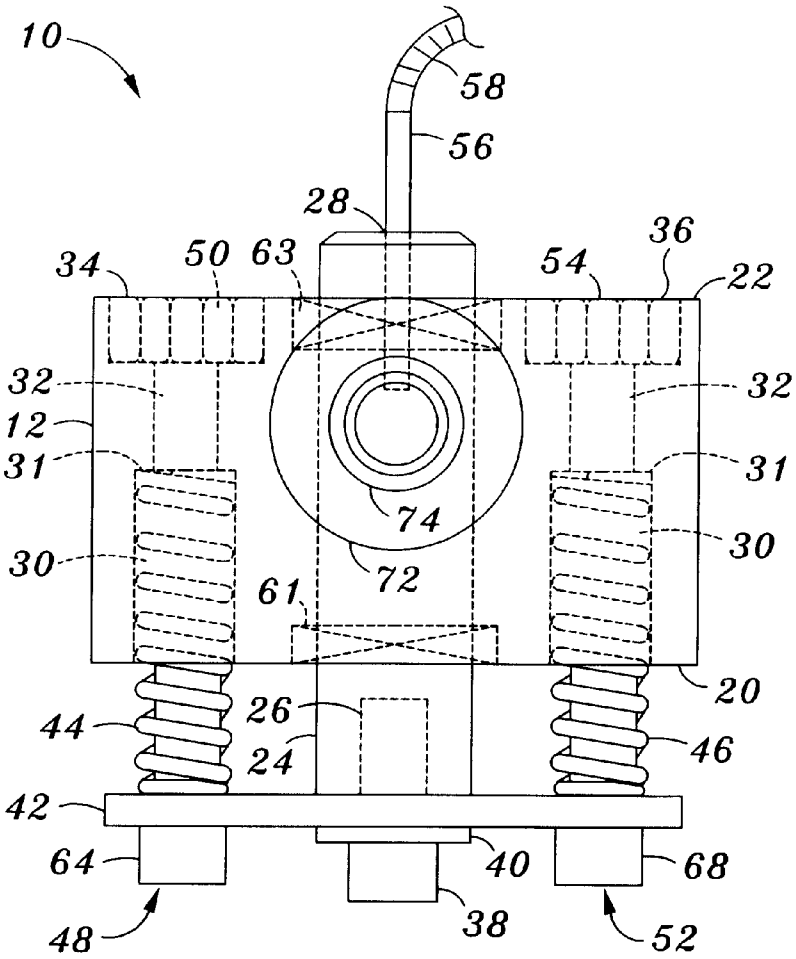
FIG. 2 illustrates a top view of the oil drain plug apparatus according to the embodiment of FIG. 1.

FIG. 1 illustrates an isometric view of an oil drain plug apparatus 10 according to one embodiment of the present invention. In this embodiment, bolts 48 and 52 are actually inserted through apertures 45 and 47, respectively, but are shown between plate 42 and housing 12, to allow the parts to fit on a single drawing sheet. FIG. 2 illustrates a top view of the oil drain plug apparatus 10 according to the embodiment of FIG. 1. Referring to FIGS. 1 and 2, the oil drain plug apparatus 10 comprises a housing 12 that has a first opening 14 substantially across the middle of the housing 12 between a front end 20 and a back end 22. In one embodiment, the housing 12 is made out of a metal (e.g., aluminum) or a combination of metals. In the preferred embodiment, the opening 14 is circular, although this is not a requirement. A substantially circular member 24 (hereinafter referred to as a "rod") is placed in the first opening 14, and is movable within the opening 14 between first and second positions in a direction substantially perpendicular to the front and back ends 20 and 22 of the housing 12.

The rod 24 includes a first threaded aperture 26 at one end to screwably receive a threaded bolt 38 where the diameter of the first aperture 26 is substantially the same as the diameter of the neck of the bolt 38. The bolt 38 is screwed into the threaded aperture 26 through a plate 42 having a first aperture 43 such that the plate 42 is secured to the rod 24. The first aperture 43 may be optionally threaded. A washer 40 is placed between a head of the bold 38 and the plate 42. Thus, the plate 42 moves with the rod 24 when the rod 24 is moved within the opening 14 between the first and second positions. First and second seals 60 and 62 are placed in respective first and second seal grooves 61 and 63 at the front and back ends 20 and 22, respectively, of the housing 12 to prevent oil leakage. In one embodiment, the rod 24 is made from stainless steel.

The rod 24 further includes a second threaded circular aperture 28 located at an opposite end to screwably receive a threaded connecting member 56 where the diameter of the second aperture 28 is substantially the same as the diameter of the connecting member 56. In one embodiment, the connecting member 56 is made from stainless steel. Alternatively, the connecting member 56 may be removably fastened to rod 24. The connecting member 56 is coupled to a cable 58 that is routed to a release and locking apparatus (see, e.g., FIG. 6) located in an engine compartment or other location of a vehicle for remotely moving the rod 24 between the first and second positions, as will be described in more detail below. In alternative embodiments, the rod 24 may be moved electrically, electronically, or magnetically.

The housing 12 further includes second and third openings 16 and 18 located at either side of the first opening 14, extending between the front and back ends 20 and 22 of the housing 12. Each of the second and third openings 16 and 18 includes a first section 30 that is threaded, and a second section 32, where the diameter of the first section 30 is greater than the diameter of the second section 32.

A first spring element 44, having a diameter slightly smaller than the diameter of the first section 30, but greater than the diameter of the second section 32, is placed in the opening 16 such that one end of the spring element 44 rests against a wall 31 and an opposite end of the spring element 44 protrudes from the front side 20 of the housing 12. Similarly, a second spring element 46, having a diameter slightly smaller than the diameter of the first section 30, but greater than the diameter of the second section 32, is placed in the opening 18 such that one end of the spring element 46 rests against the wall 31 and an opposite end of the spring element 46 protrudes from the front side 20 of the housing 12.

Incorporated into the back end 22 of the housing 12 are first and second recessed areas 34 and 36 located around the second section 32 of the first and second openings 16 and 18, respectively. A bolt 48 having a head 64 and a neck 66 (at least a portion of which is threaded) is inserted through a second aperture 45 of the plate 42 and the first spring element 44. The bolt 48 is then screwed into the second portion 32 of the opening 16 until it protrudes out of the first recessed area 34. A nut 50 may then be screwed to the threaded neck 66 in the first recessed area 34 to further secure the bolt 48. The second aperture 45 of the plate 42 has a diameter smaller than the diameter of the head 64 of the bolt 48, but greater than the diameter of the neck 66 of the bolt 48 such that the plate 42 can move freely through the neck 66 as the rod 24 is moved between the first and second positions.

Similarly, a bolt 52 having a head 68 and a neck 70 (at least a portion of which is threaded) is inserted through a third aperture 47 of the plate 42 and the second spring element 46. The bolt 52 is then screwed into the second portion 32 of the opening 18 until it protrudes out of the second recessed area 36. A nut 54 may then be screwed to the threaded neck 70 in the second recessed area 36 to further secure the bolt 52. The third aperture 47 of the plate 42 has a diameter smaller than the diameter of the head 68 of the bolt 52, but greater than the diameter of the neck 70 of the bolt 52 such that the plate 42 can move freely through the neck 70 as the rod 24 is moved between the first and second positions. A locking pin 25 is inserted through a fourth opening 49 of the plate 42 and an aperture 27 of the rod 24 to prevent rotating of the rod 24.

In an alternative embodiment, the openings 16 and 18 stop short of the back end 22 of the housing 12 such that the recessed areas 34 and 36 and the nuts 50 and 54 are not needed. In this embodiment, the bolts 48 and 52 are directly screwed into the respective second sections of the openings 16 and 18. A lock tight, liquid glue or equivalent may be optionally placed in the chambers 16 and 18 to prevent bolts 48 and 52 from becoming loose due to vibrations.

Figure 3:
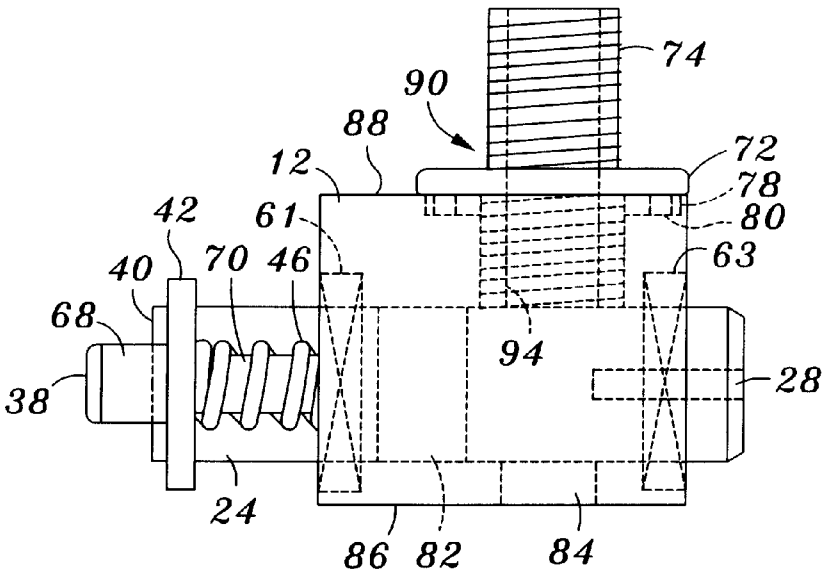
FIG. 3 illustrates a side view of the oil drain plug apparatus of FIG. 1.

FIG. 3 illustrates a side view of the oil drain plug apparatus 10 of FIG. 1. Referring to FIGS. 1 through 3, the housing 12 includes a threaded top opening 76, extending from a topside 88 of the housing 12 to the opening 14 and substantially perpendicular to such opening 14, for screwably receiving a threaded inlet port 92 of an oil drain plug 90. The diameter of the opening 76 is substantially the same as the diameter of the inlet port 92.

The oil drain plug 90 further includes an outlet port 74 that protrudes from the topside 88 of the housing 12 for mounting the same to an oil pan (not shown) of a motor vehicle or other device in lieu of a conventional oil drain plug. The diameter of the outlet port 74 may vary depending on the diameter of the oil pan opening, as different vehicles have different diameter oil pan openings. In addition, the diameter of the outlet port 74 may differ than the diameter of the inlet port 92. The oil drain plug 90 has an inner diameter 94, as shown in FIG. 3 by dashed lines. A stop 72 is mounted around the oil drain plug 90 in between the inlet port 92 and the outlet port 74. The stop 72 seals the opening 76 from the topside 88. A circular sealing channel 78 having an O-ring (seal) 79 is incorporated on the topside 88 of the housing 12 to prevent oil leakage.

Figure 4:
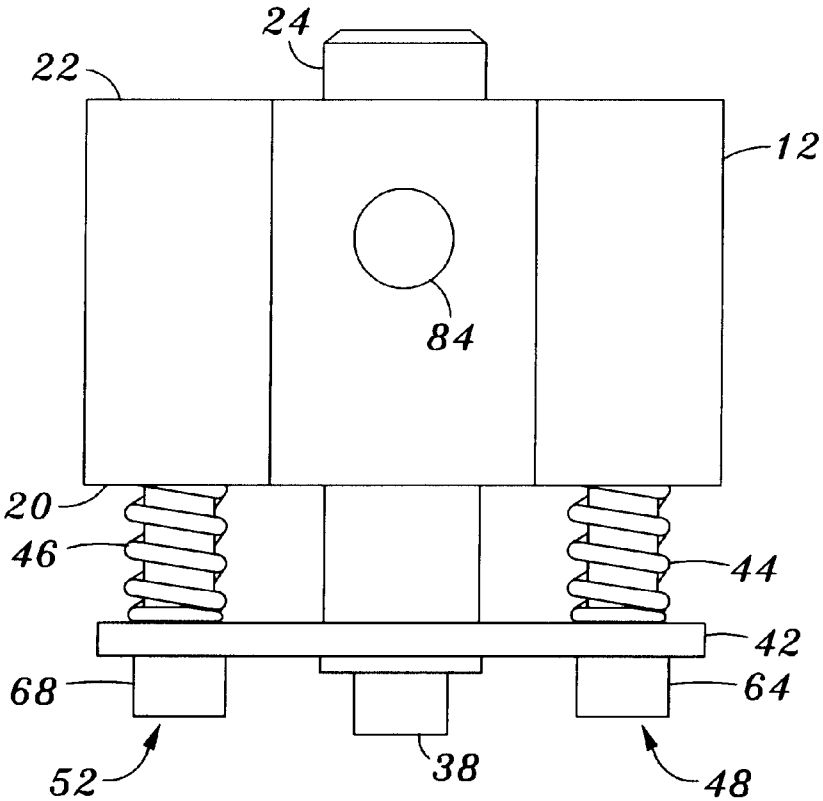
FIG. 4 illustrates a bottom view of the oil drain plug apparatus of FIG. 1.

The housing 12 further includes a bottom opening 84 extending from the bottom-side 86 of the housing 12 to the opening 14 and is substantially perpendicular to the opening 14. The bottom opening 84 is also illustrated in FIG. 4, which illustrates a bottom view of the oil plug apparatus 10 of FIG. 1. The opening 84 has a diameter substantially equal to and is substantially aligned with the inner diameter 94 of the oil drain plug 90. The rod 24 further includes a center opening 82 extending from the center of the rod in a direction substantially perpendicular to the length of the rod 24.

Figure 5:
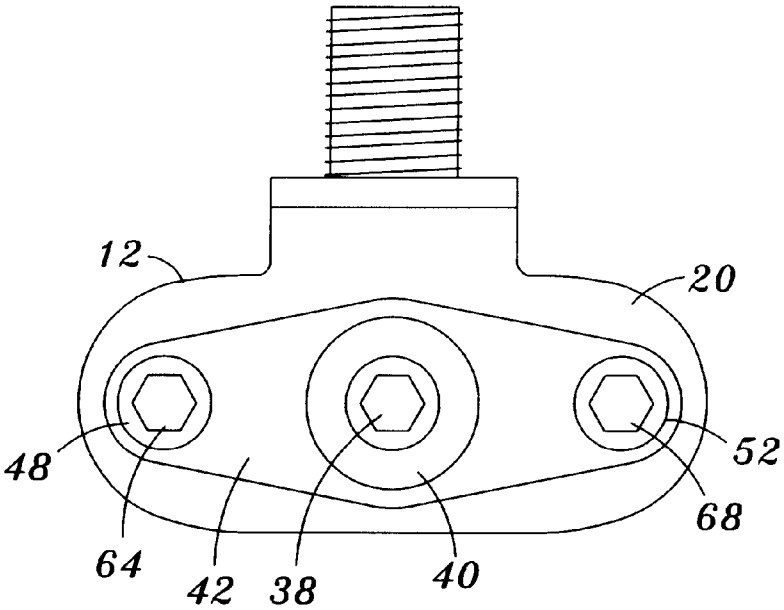
FIG. 5 illustrates a front view of the oil drain plug apparatus of FIG. 1.

In the first position (normal position), the oil drain plug apparatus 10 is as shown in FIG. 3 where the center opening 82 is not aligned with the top and bottom openings 76 and 84, preventing oil from draining from an oil pan. In this position, the spring elements 44 and 46 prevent the rod 24 from moving due to vibrations. The combination of the bolts 48 and 52 and the spring elements 44 and 46 prevent twisting and moving of the rod 24 due to vibrations. When oil is to be drained from an oil pan, the rod 24, using the connecting member 56 (and cable 58), is moved to the second position where the center opening 82 is substantially aligned with the top and bottom openings 76 and 84. As the rod 24 is moved from the first position to the second position, the spring elements 44 and 46 provide resistance such that if the cable 58 is released or otherwise breaks, the spring elements 44 and 46 force the rod 24 back to the first position, preventing oil from being drained. When the oil is drained, the rod 24 is moved back to the first position. A front view of the oil drain plug apparatus 10 of FIG. 1 is shown in FIG. 5. The cable 58 may extend to the engine compartment of the vehicle such that the engine oil may be drained without needing to crawl under the car.

Figure 7:
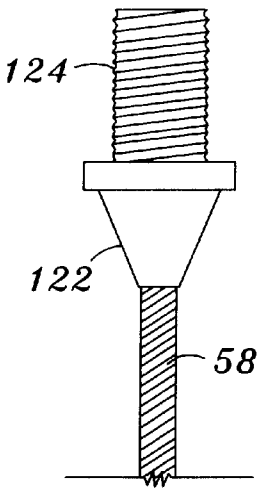
FIG. 7 illustrates a connecting member according to one embodiment of the present invention.
Figure 6:
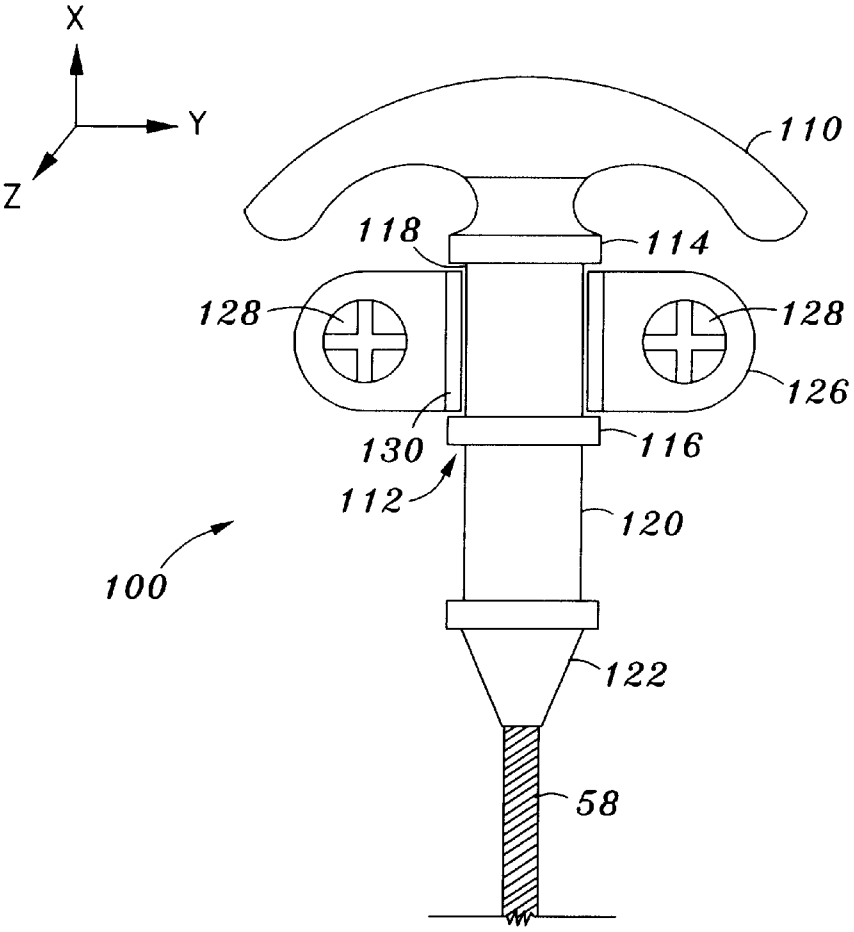
FIG. 6 illustrates a side view of a release and locking apparatus according to one embodiment of the present invention.

FIG. 6 illustrates a side view of a release and locking apparatus 100 according to one embodiment of the present invention. Referring to FIG. 6, the release and locking apparatus 100 includes a handle 110 coupled to a circular member 112. The circular member includes first and second ring portions 114 and 116 of a first diameter, and third and fourth portions 118 and 120 having a second diameter, where first diameter is greater than the second diameter. The release and locking apparatus 100 also includes a connecting member 122 having a first end coupled to the circular member 112, and a second end connected to the cable 58. In one embodiment, the connecting member 122 includes a threaded neck 124 that is screwably coupled to the circular member 112, as shown in FIG. 7.

The release and locking apparatus 100 also includes a holding member 126 that is secured to a part of the vehicle (e.g., engine compartment, trunk, etc.) by way of securing members 128 (e.g., screws). The holding member 126 includes a semi-circular portion 130 about the mid-section of the holding member 126 where the diameter of the portion 130 is slightly smaller than the diameter of the third and fourth portion 118 and 120 of the circular member 112. When the rod 24 (FIG. 1) is in the first position (normal operation), the third portion 118 of the circular member 112 is placed in the semi-circular portion 130 (as depicted in FIG. 6). The first and second ring portions 114 and 116 prevent the circular member 112 (and the cable 58) from moving. To move the rod 24 to the second position and drain engine oil, the handle 110 is pulled out in the Z-direction, pulled toward the X-direction, and then moved in the negative Z-direction such that the fourth portion 120 of the circular member 112 is placed in the semi-circular portion 130. In this second position, the second ring portion 116 rests against the top of the semi-circular portion 130, preventing the circular member 112 (and cable 58) from moving. Once the oil is drained, the handle 110 is moved back to its original position.

Figure 8:
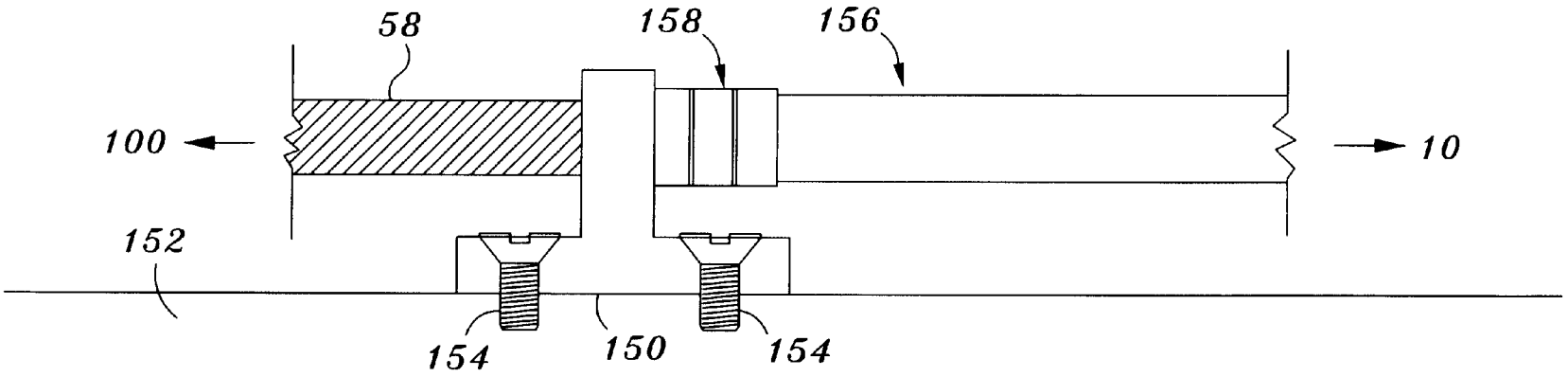
FIG. 8 illustrates a side view of a stopper according to one embodiment of the present invention.

FIG. 8 illustrates a side view of a stopper 150 according to one embodiment of the present invention. In the preferred embodiment, a first stopper is located near the release and locking apparatus 100 (FIG. 6) and a second stopper is located near the housing 12 (FIG. 1). Referring to FIG. 8, the stopper 150 is secured to a member 152 (e.g., a vehicle body or other structure) by way of securing members 154. The stopper 150 includes an aperture (not shown) where the cable 58 passes therethrough. A cable cover 156 having an end portion 158 covers the cable 58 between the first and second stoppers. The diameter of the aperture of the stopper 150 is smaller than the diameter of end portion 158 of the cable cover 156, thereby preventing the cable cover 156 from moving as the cable 58 moves.

It must be noted that the size and shape of the housing 12 may vary depending on design choice without departing from the spirit and scope of the present invention. While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art.

What is claimed is:

1. An oil drain plug apparatus, comprising:

a plug having an inlet port and an outlet port for mounting to an oil pan;

a rod including first and second ends, and an opening therethrough;

a housing including a first opening therethrough from a first side to a second, opposite side, and a second opening therethrough from a third side to a fourth, opposite side that coincides with the first opening, said first and second openings being in planes perpendicular to each other, the rod being located in the first opening between first and second positions, and the second opening screwably receives the inlet port of the plug;

a plate coupled to the first end of the rod;

one or more spring elements coupled between the plate and the housing, said one or more spring elements providing resistance to maintain the rod in the first position; and an engaging member coupled to the second end of the rod, the engaging member for moving the rod to the second position such that the opening of the rod is substantially aligned with the second opening for allowing drainage of oil from the oil pan wherein the one or more spring elements comprises first and second spring elements, and wherein the housing forms third and fourth opening parallel to the first opening, said apparatus further comprising:

first and second bolts slidably coupled to the plate and placed in the third and fourth openings, respectively, and fixedly coupled to the housing, said first and second spring elements being placed inside the third and fourth openings, respectively, and around the first and second bolts.

2. The oil drain plug apparatus of claim 1 further comprising first and second seals placed in respective first and second seal grooves located around the first opening at the respective first and second sides of the housing.

3. The oil drain plug apparatus of claim 1 wherein the housing is made from metal.

4. The oil drain plug apparatus of claim 1 wherein the engaging member is located in an engine compartment of a vehicle.

5. The oil drain plug apparatus of claim 1 wherein the housing forms circular first and second openings, and the rod is substantially cylindrical.

6. An oil drain plug apparatus, comprising:

a rod including first and second ends, and an opening therethrough;

a housing including a first opening therethrough from a first side to a second, opposite side, and a second opening therethrough from a third side to a fourth, opposite side that coincides with the first opening, said housing further including third and fourth openings substantially parallel to the first opening, the rod being located in the first opening between first and second positions;

means for coupling the second opening of the housing to an oil pan;

first and second bolt means being partially placed in the third and fourth openings, respectively, and coupled to the housing;

plate means coupled to the first end of the rod and slidably coupled to the first and second bolt means;

first and second spring means coupled around the first and second bolt means, respectively, and between the plate means and the housing, at least a portion of the first and second spring means being located in the third and fourth openings, said first and second spring means providing resistance to maintain the rod in the first position; and means for moving the rod to the second position against the force of the first and second spring means until the opening of the rod is substantially aligned with the second opening of the housing for allowing drainage of oil from the oil pan through said means for coupling.

7. The oil drain plug apparatus of claim 6 further comprising first and second sealing means placed in respective first and second seal grooves located around the first opening at the respective first and second sides of the housing.

8. The oil drain plug apparatus of claim 6 wherein the housing is made from metal.

9. The oil drain plug apparatus of claim 6 wherein said means for moving is located in an engine compartment of a vehicle.

10. The oil drain plug apparatus of claim 6 wherein the housing forms a circular first opening, and the rod is substantially cylindrical.

* * * * *